US007165625B2

(12) United States Patent
Long

(10) Patent No.: US 7,165,625 B2
(45) Date of Patent: Jan. 23, 2007

(54) FIRE EXTINGUSHING SYSTEM

(76) Inventor: Julius Long, 734 W. Oak Forrest Dr., Charleston, SC (US) 29407

( * ) Notice: Subject to any disclaimer, the term of this patent is extended or adjusted under 35 U.S.C. 154(b) by 0 days.

(21) Appl. No.: 10/709,602

(22) Filed: May 17, 2004

(65) Prior Publication Data

US 2004/0231863 A1 Nov. 25, 2004

Related U.S. Application Data

(63) Continuation-in-part of application No. 10/248,609, filed on Jan. 31, 2003, now abandoned.

(60) Provisional application No. 60/372,825, filed on Apr. 17, 2002, provisional application No. 60/372,823, filed on Apr. 17, 2002, provisional application No. 60/372,824, filed on Apr. 17, 2002, provisional application No. 60/361,371, filed on Mar. 5, 2002, provisional application No. 60/361,370, filed on Mar. 5, 2002, provisional application No. 60/361,372, filed on Mar. 5, 2002, provisional application No. 60/354,212, filed on Feb. 7, 2002, provisional application No. 60/354,211, filed on Feb. 7, 2002, provisional application No. 60/354,213, filed on Feb. 7, 2002, provisional application No. 60/352,497, filed on Jan. 31, 2002, provisional application No. 60/352,498, filed on Jan. 31, 2002.

(51) Int. Cl.
*A62C 3/00* (2006.01)
*A62C 35/00* (2006.01)

(52) U.S. Cl. ..... 169/46; 169/12

(58) Field of Classification Search ..... 169/46, 169/12, 84, 45
See application file for complete search history.

(56) References Cited

U.S. PATENT DOCUMENTS

| | | | | | |
|---|---|---|---|---|---|
| 4,099,572 | A | * | 7/1978 | Vasilenko et al. | 169/12 |
| 4,113,019 | A | * | 9/1978 | Sobolev et al. | 169/12 |
| 4,614,237 | A | * | 9/1986 | Colodner et al. | 169/12 |
| 5,046,564 | A | * | 9/1991 | Poulsen | 169/47 |
| 5,848,652 | A | * | 12/1998 | Bennett | 169/62 |
| 5,918,679 | A | * | 7/1999 | Cramer | 169/45 |
| 6,012,533 | A | * | 1/2000 | Cramer | 169/45 |

* cited by examiner

*Primary Examiner*—David A. Scherbel
*Assistant Examiner*—Darren Gorman
(74) *Attorney, Agent, or Firm*—Michael L. Greenberg, Esq.; Greenberg & Lieberman, LLC

(57) ABSTRACT

A method of stopping and containing fires involving, in one embodiment, taking the fumes from a turbine, jet or any chemical source, and running it through a giant muffler, radiator, or pipe. The radiator cools the fumes down from the engine or chemical store. This is a system that uses the fumes to cool the fire down, it will suck the heat and oxygen away, and replace it with a non-combustible gas. This system can also be used to put out architectural fires, by blowing the fumes in the building from one side, keeping oxygen from entering the building, by building up pressure, until no more oxygen can enter the building.

1 Claim, 2 Drawing Sheets

FIRE EXTINGUSHING SYSTEM

CROSS REFERENCE TO RELATED APPLICATIONS

Priority is claimed to Ser. No. 60/352,497 Jan. 31, 2002; Ser. No. 60/354,212 Feb. 7, 2002; Ser. No. 60/354,211 Feb. 7, 2002; Ser. No. 60/354,213 Feb. 7, 2002; Ser. No. 60/361,371 Mar. 5, 2002; Ser. No. 60/361,370 Mar. 5, 2002; Ser. No. 60/352,498 Jan. 31, 2002; Ser. No. 60/361,372 Mar. 5, 2002; Ser. No. 60/372,825 Apr. 17, 2002; Ser. No. 60/372,823 Apr. 17, 2002; Ser. No. 60/372,824 Apr. 17, 2002; and Ser. No. 10/248,609.

BACKGROUND OF INVENTION

1. Field of the Invention

The present invention relates to a fire extinguishing system, and more specifically a system that uses the exhaust fumes and pressure from a powerful engine to displace and remove the oxygen from the fire, which results in the fire being extinguished very quickly.

2. Background of the Invention

The present invention solves the problem associated with the inability of conventional fire extinguishing equipment, specifically that the equipment cannot extinguish large-scale fire. Over the last decade, we have seen countless incidents where wild fires have destroyed thousands of acres of forest and homes. Although many devices and techniques have been employed, none have been able to stop the spread of these devastating fires, nor have any other devices been able to put these fires out. The calculation of loss of property, forestry and even the loss of life is difficult to determine. In totality, several states, many communities and thousands of individuals have lost hundreds of millions of dollars.

SUMMARY OF INVENTION

The present invention is a system for extinguishing fires. The system is comprised of two vehicles, a fire truck and a trailer. The present invention is used to displace the oxygen from over the fire, and this results in the fire being quickly extinguished.

The fire truck component has a jet engine attached to the top of the fire truck. The present invention uses the cooled down exhaust fumes from a jet engine that is attached to the top of the fire truck. The exhaust from the jet engine is directed through a series of pipes that channel the exhaust through the radiator cooling system contained inside the fire truck. The pipes are submerged in a cooling tank filled with cold water. As the fumes pass through the radiator fumes, it is cooled down considerably.

The cooled exhaust then passes through a hose to a second vehicle, the trailer where the fumes are filtered for water, soot, oil, and other by products of the jet engine exhaust. The particles are separated and the fumes are passed on out through the dispenser guns and onto the fire. The pressure from the exhaust is used to blow the oxygen away from the fire. Once the oxygen has been removed from the fire, the fire will go out.

The second vehicle, the trailer vehicle can be attached to the fire truck and pulled behind the fire truck when responding to fire emergencies. During the fire extinguishing process, the two vehicles are connected by the hose. The vehicles can be controlled manually or by remote control.

The present invention can be used to extinguish fires in burning buildings. It is also very effective on large-scale fires. Oil well fir, aircraft, forest fires and other large fires will be extinguished quickly when the present invention is used. When the present invention is used on large-scale outdoor fires, such as forest fires, the trailer vehicle has the ability to also dispense sand that will smother the fire.

The second vehicle has two gun type dispensers that dispense substances from the trailer vehicle. One of the dispensers will shoot out sand onto the fire. The other will guide the fumes onto the fire. Each of the gun dispensers is rotatable, retractable, and extendable. Each can also be remotely controlled to direct their substances directly onto the fire. There is also a third hose attachment on the front of the trailer vehicle. This embodiment is used when sand has been dispensed from the trailer and needs to be removed from the premises. The vacuum gun will remove debris once the fire has been extinguished.

DETAILED DESCRIPTION

Figure 1:
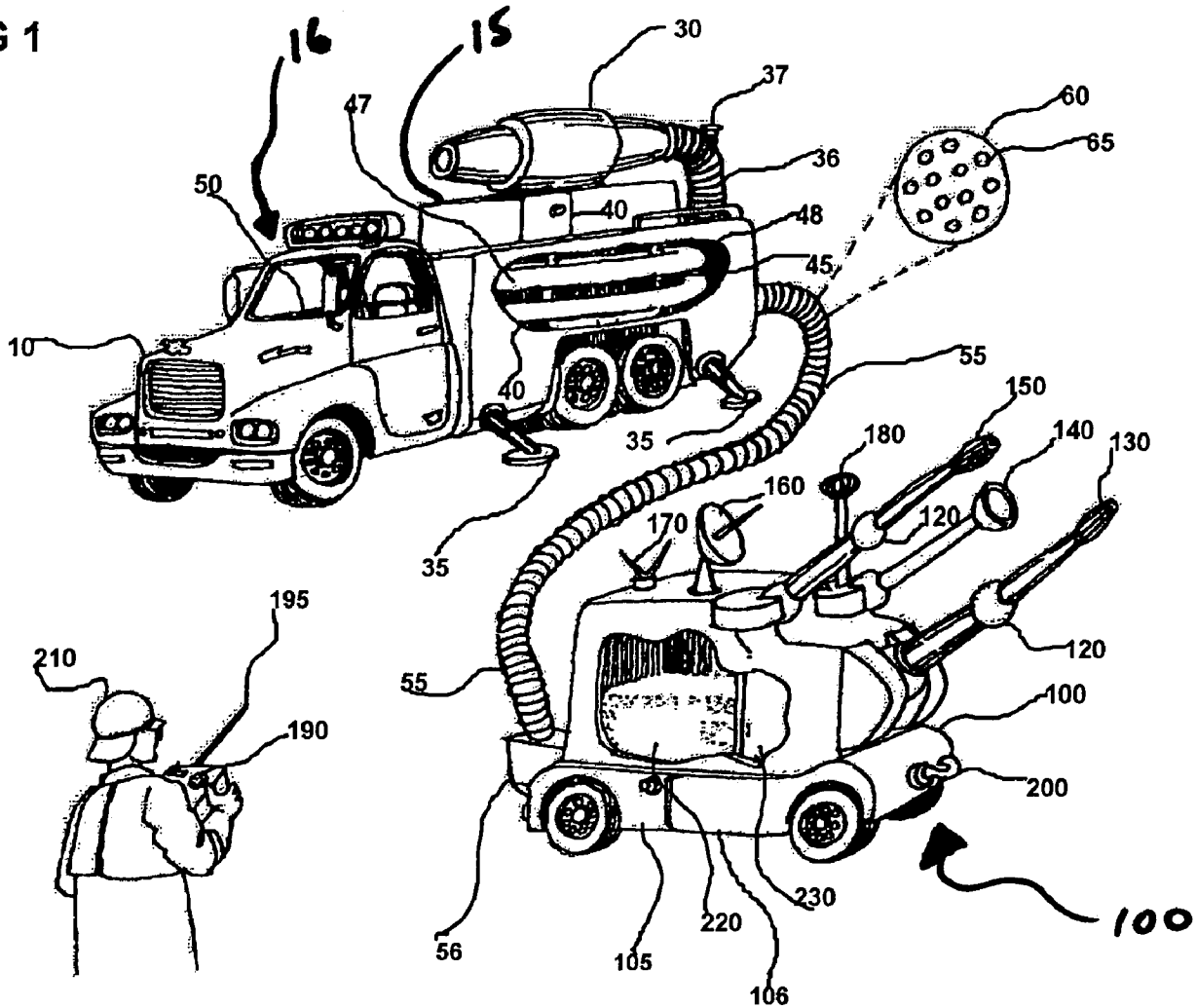
FIG. 1 shows a trailer embodiment of the present invention.
Figure 3:
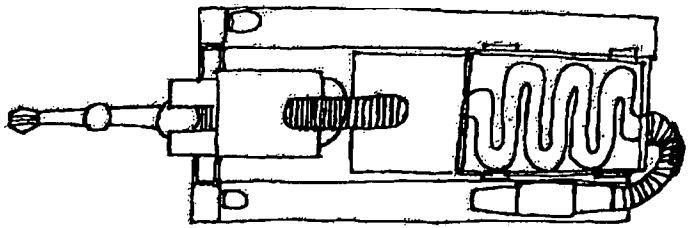
FIG. 3 shows an alternative view of the second embodiment of the present invention.
Figure 4:
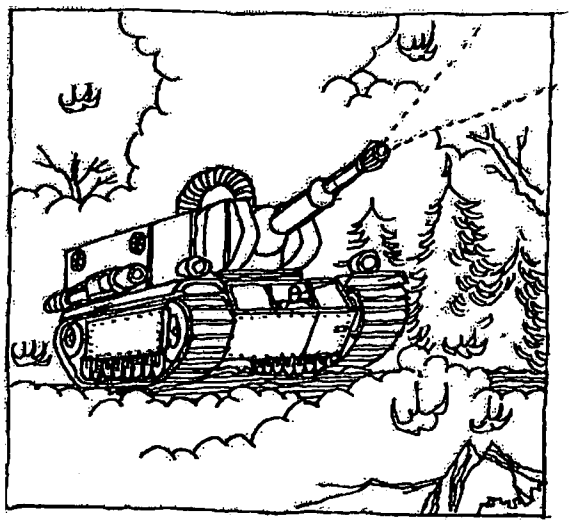
FIG. 4 shows another alternative view of the second embodiment of the present invention.

The present invention is a two-vehicle system comprised of many features for the quick extinguishing of small and large-scale fires. It can be used on building fires, oil fires, aircraft fires, forest fires and any other fire where a quick extinguishing is necessary.

There are two main vehicles, the fire truck (10) and the trailer vehicle (100). The fire truck (10) has a conventional fuel injected engine and a fuel tank (15) attached on top of the truck which holds the fuel to power the fire truck (10). The fire truck (10) is controlled from within the cabin (16) of the fire truck (10). The fire truck (10), and the mechanisms of the jet engine (30) and the radiator system (40) are controlled by a control panel (50) located inside the fire truck (10).

When the present invention is used to respond to a fire emergency, the jet engine (30) is activated and exhaust fumes are produced when the jet engine (30) is idling. If additional pressure is needed the jet engine can be throttled up. Because the jet engine (30) is so powerful, a conventional brake mechanism is employed to keep it stationary while it is operating. Additionally, the fire truck (10) may be secured by retractable stabilizers (35) located on the outer lower edge of the fire truck (10). When the jet engine (30) is powered up, it will produce exhaust fumes that will result in the exhaust being directed by a first hose unit (36) and the directed exhaust fumes will go into the coils of the radiator cooling system (40). There will be a high volume of hot, pressurized fumes directed through the first hose unit (36), so there is a pressure valve (37) that can be controlled to release some of the pressure when needed from the first hose unit (36). The pressure valve (37) may be operated conventionally by hand or if too hot to touch may be opened remotely (not shown) The radiator cooling system (40) is comprised of several sets of coils (47) and pipes (45) used to carry the exhaust fumes through the radiator cooling system (40). The pipes (45) and the coils (47) are submerged into a cooling tank (48). The cooling tank (48) allows cool water to flow freely around the pipes and coils (47) to cool down the exhaust fumes before the fumes are passed further into the second hose unit (55).

The second hose unit (55) is shown in detail in cut out (60), reveals metal plates (65) that are welded inside the second hose unit (55) so that the heat will flow to outside wall of second hose unit (55). By allowing the heat to flow to the outside of the second hose unit (55), this helps to regulate the temperature of the fumes. The temperature of the fumes most be maintained at below 350 degrees so they will not cause other surfaces to ignite. When the temperature inside the first hose unit (36) and the second hose unit (55) is above the prescribed temperature, the internal pressure in the units (36 & 55) will increase thereby forcing the pressure valve (37) to open to release an appropriate amount of pressure to reduce the temperature of the fumes inside the first hose unit 36 and second hose unit (55). The valve (37) is self closing through the use of conventional means. The preferred method is that of gravity and the use of magnetism.

Both the first hose unit and second hose unit (55) are made of a conventional fire proof material that can withstand the heat, pressure and volume of the exhaust fumes traveling within the hose units.

The radiator cooling system (40) cools the fumes down from the jet engine (10). Once the fumes have passed through the radiator cooling system (40) and then through the second hose unit (55) it is then carried into the trailer (100). The trailer unit filter system (56) will filter all debris such as water, oil, soot and other agents out of the fumes and then the fumes will travel up to the fume compartment (230). The fumes are stored in the fumes compartment (230) until they are to be dispensed onto a fire through the fume gun (130).

The trailer (100) in the preferred embodiment can be controlled by the main controls located on the control panel 50 in the fire truck. Or in an alternative embodiment, the present invention can be remotely controlled by a user (210), using a remote control device 190. Because of the dangerous nature of fire fighting, controlling the present invention by the remote control device is the safest method of operating the present invention.

The trailer (100) is powered by a conventional engine, with the preferred type being a diesel-powered engine (105). The trailer (100) has other functions, such as the filtering of the exhaust, feeding the sand to the sand gun (150), operating the vacuum (140) and directing the fumes to the fume gun (130) and each is powered by a generator (106) that gets it's main source of power from the diesel powered engine (105).

The trailer (100) is attached during the operation of the present invention. The trailer (100) has two storage compartments. One is the fumes compartment (230) and the other one is the sand storage compartment (220). Sand is stores inside until is necessary to dispense it onto a fire. The sand and the fumes are both used in conjunction to extinguish a fire. The present invention can operate with either using just the fumes or the fumes and the sand in conjunction with one another. Using only the fumes alone will not lessen the ability of the present inventions to quickly extinguish a fire.

The trailer (100) has three attachments on the outer front side. These are used for various functions of the present invention. The sand gun (150) dispenses sand onto the fire and it will aid in distinguishing the fire by smothering the fire. The vacuum gun (140) will only be used in instances where the present invention is used on a building or an enclosed area. The vacuum gun (140) will be used after the fire has been extinguished and there is a large amount of smoke and heat remaining. The vacuum gun (140) will remove the smoke and heat from the area. There is an exhaust pipe 180 that takes the exhaust from diesel engine (105) and the generator (106). The sand gun (150) and fume gun 130 each have a maneuverable ball (120) that allows them to move in what ever direction necessary to dispense either sand or fumes in the direction of the fire. The trailer (100) can be remotely controlled using a remote control device (190). The remote control device uses a conventional remote control technology, preferably Blue Tooth (trademark) Wireless technology, however wifi, radio or other means may be employed. The signal is carried between the remote control signaling device (195) and the receiver (160) attached to the trailer (100). The user (210) uses the remote control device (190) to control the functions and the functions of the trailer 100. The user (210) also controls and monitors the temperature on the fumes as contained in the first hoes unit (36) and the second hose unit (55). The user (210) also controls the pressure valve (37) that allows the heat and pressure to escape when the levels of pressure are above the levels of the prescribed systems. There is also a method of control for the trailer 100, located on the control panel 50 in the fire truck 10. The method of control between the fire truck 10 and the trailer 100 is wireless and uses the Blue Tooth Wireless (trademark) and it is controlled from the control panel 50 to the trailer 100, and the signal is received 170 on top of the trailer 100.

In an alternative embodiment, the present invention can be used in the forest and in heavy terrain.

Figure 2:
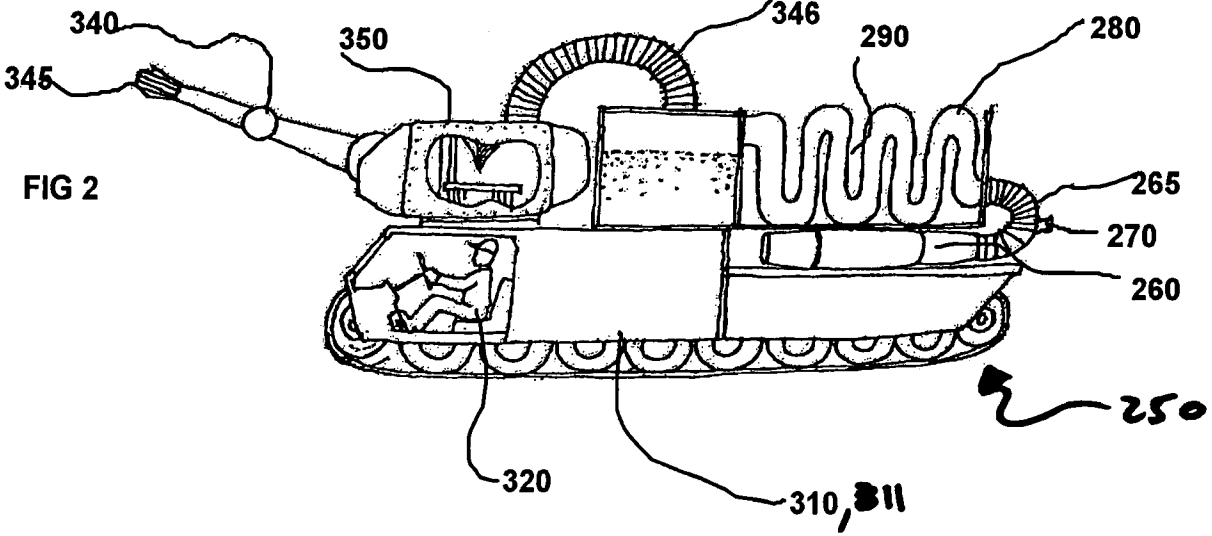
FIG. 2 shows a second embodiment of the present invention.

As shown in FIG. 2, the present invention is embodied in one tank unit 250. The tank unit 250 has all the embodiments of the present invention built into one unit. The tank is powered by a diesel engine 310 and a generator 311 is used to power the other functions of the tank unit 250. The generator 311 receives its power from the diesel engine 310. The jet engine 260 is mounted on the side of the tank unit 250 and the exhaust fumes travel through the hose unit 265 and then the fumes go into the coils 280 of the cooling system. The coils 280 are cooled by open air-cooling unit 290. The pressure valve 270 allows excessive pressure to escape the system and this pressure valve 270 can be controlled from the control panel located inside the cabin 320 of the tank unit. Once the exhaust has been cooled it passes into the fume compartment 346 and then it passes further into the mixing compartment 350 and it is mixed with the sand. The mixture of sand and exhaust is then sent out of the mixing compartment 350 and sent to the rotatable spray arm gun 340. The sand and exhaust is moved from the mixing compartment 350 through the use of conventional means normally used in grain hoppers and the like. The proffered method is the use of a three tined rotor (not shown), which is turned by a conventional motor (not shown). The exhaust moving through the system will also help to move the rotor (not shown) and as such the rotor is of the type which allows as forward motion with out any resistance. The rotor scoops the sand from the hopper (not shown) and directs the spray out of the hopper, along with the fumes as a mixture out onto the fire through the expandable spray head 345. The sand is continually raised through the use of springs, which lift the hopper as it is emptied. Other methods of raising the hopper may be used, such as hydraulics, electronic devices, etc. The tank unit 250 operates in the same manner as the preferred embodiment except the tank unit 250 is for operating on heavy terrain.

The expandable spray head is moved about by the user through the use of the remote control device and encased electrical motors (not shown). Other methods for moving the spray head (345), such as hydraulics, air pressure, etc. may also be used.

It is intended to be understood that only preferred depictions of the present invention have been described and that numerous substitutions, modifications, and alterations are allowable and are explained in the following claims.

I claim:

1. A method for extinguishing a fire, comprising:

directing exhaust from a jet engine into a series of pipes;

channeling the exhaust through a radiator cooling system such that the series of pipes are submerged in a cooling tank filled with cold water;

filtering the exhaust for water, soot, oil, and other by products of jet engine exhaust;

then dispensing the exhaust onto the fire.

* * * * *